US005113727A

United States Patent [19]

Foster

[11] Patent Number: 5,113,727

[45] Date of Patent: May 19, 1992

[54] PLIERS WITH REMOVABLE JAW INSERTS

[75] Inventor: Kenneth L. Foster, Garland, Tex.

[73] Assignee: Stanley-Bostitch, Inc., New Britain, Conn.

[21] Appl. No.: 783,510

[22] Filed: Oct. 28, 1991

[51] Int. Cl.[5] ..... B25B 2/02

[52] U.S. Cl. ..... 81/423; 81/421; 81/422

[58] Field of Search ..... 81/423, 421, 422, 420, 81/418

[56] References Cited

U.S. PATENT DOCUMENTS 4,109,845 8/1978 Wedge et al. ..... 81/423

*Primary Examiner*—Bruce M. Kisliuk
*Assistant Examiner*—Lawrence Cruz
*Attorney, Agent, or Firm*—Jones, Askew & Lunsford

[57] ABSTRACT

A novel configuration for mounting a removable jaw insert to a pair of pliers. The pliers include mutually opposing, articulating jaws. A recess is formed in at least one of the jaws, and a flange is formed on the jaws adjacent the recess. A jaw insert has a mating portion dimensioned to be received within the recess in the jaws and includes a hook portion projecting from a lateral edge. A leg extends perpendicularly from the opposite lateral edge of the jaw insert. The hook portion of the jaw insert engages the flange formed on the corresponding jaw to secure the hook portion of said jaw insert to the jaw. A pin is then inserted through a bore in the leg of the jaw insert and into a corresponding bore in the jaw to removably secure the jaw insert to the pliers.

3 Claims, 3 Drawing Sheets

PLIERS WITH REMOVABLE JAW INSERTS

TECHNICAL FIELD

The present invention relates generally to tools, particularly pliers. Stated more specifically, the present invention relates to pliers having removable jaw inserts and to a novel arrangement for mounting the jaw inserts to the jaws of the pliers.

BACKGROUND OF THE INVENTION

Pliers are known wherein rather than the jaws bearing directly against a workpiece, removable jaw inserts are mounted to each of the jaws and bear against the workpiece. Interchangeable jaw inserts provides a number of advantages over conventional pliers. First, damaged or worm jaw inserts are easily replaced, at a cost of considerably less than the cost of a new set of pliers. Second, jaw inserts having various bearing surface configurations, e.g. toothed, cutting, grooved, etc., may be used to adapt the pliers to a variety of applications. If desired, the upper and lower jaw inserts need not have the same bearing surface configuration, e.g. one jaw insert can be toothed and the other smooth.

SUMMARY OF THE INVENTION

Stated generally, the present invention comprises a novel configuration for mounting a removable jaw insert to a pair of pliers or the like. The pliers include mutually opposing, articulating jaws. A recess is formed in at least one of the jaws, and a flange is formed on the jaws adjacent the recess. A jaw insert has a mating portion dimensioned to be received within the recess in the jaws and includes a hook portion projecting from a lateral edge. A leg extends perpendicularly from the opposite lateral edge of the jaw insert. The hook portion of the jaw insert engages the flange formed on the corresponding jaw to secure the hook portion of said jaw insert to the jaw. A pin is then inserted through a bore in the leg of the jaw insert and into a corresponding bore in the jaw to removably secure the jaw insert to the pliers.

Thus, it is an object of the invention to provide improved pliers with removable jaw inserts.

It is anothr object of the invention to provide an improved arrangement for mounting a removable jaw insert to pliers or the like.

Other objects, features, and advantages of the present invention will become apparent upon reading the following specification, when taken in conjunction with the drawings and the appended claims.

BRIEF DESCRIPTION OF THE DRAWIGS

DETAILED DESCRIPTION OF THE DISCLOSED EMBODIMENT

Figure 1:
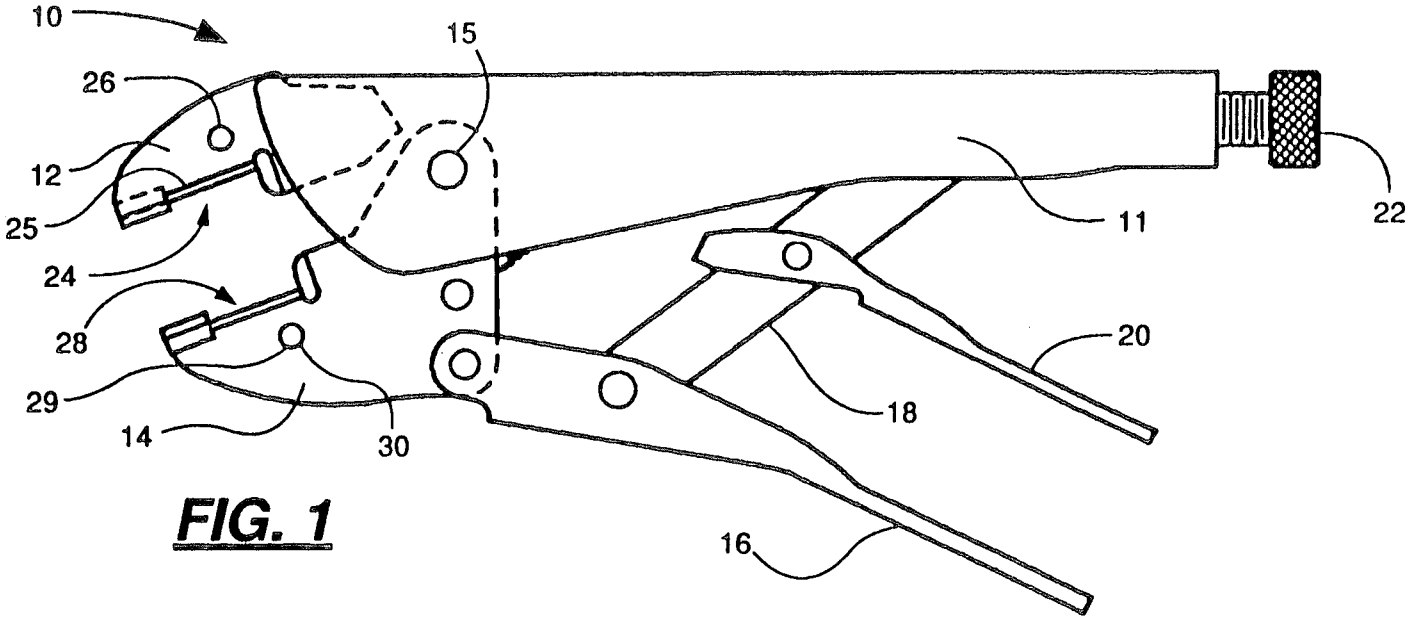
FIG. 1 shows locking pliers according to the present invention comprising jaw recesses for receiving jaw inserts.

Referring now to the drawings, in which like numerals indicate like elements throughout the several views, FIG. 1 illustrates locking pliers 10 according to the present invention. The locking pliers 10 are of cargely conventional design and include a body 11 having an upper jaw or plate 12 fixedly mounted thereto. A lower or movable jaw 14 is pivotably mounted to the body 11 by means of a body rivet 15. The pliers 10 also includes a lever 16 pivotably mounted to the movable jaw 14 and a toggle lever 18 linking the lever 16 and the body 11. A release leverr 20 is pivotably mounted to the toggle lever 18 and functions in the conventional manner to release the locking pliers. An adjusting screw 22 is threaded into the rear portion of the body 11 and also operates in the conventional manner to adjust the locking position of the movable jaw 14.

The upper jaw 12 has a recess 24 formed therein. A laterally extending flange 25 and a bore 26 are formed on the upper jaw 12 adjacent the recess 24. In a similar manner, a recess 28 is formed in the lower movable jaw 14, and a laterally extending flange 29 and a bore 30 are formed in the lower jaw adjacent the recess 28. The recesses 24, 28 are disposed in mutually opposed relation and are correspondingly aligned when the jaws 12, 14 of the pliers 10 are closed.

Figure 4:
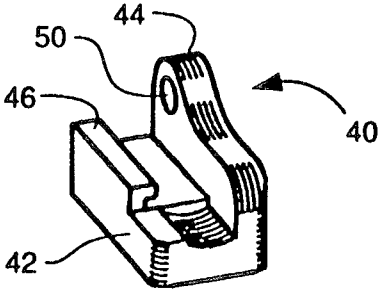
FIG. 4 is a perspective view of the jaw insert of FIG. 2.
Figure 3:
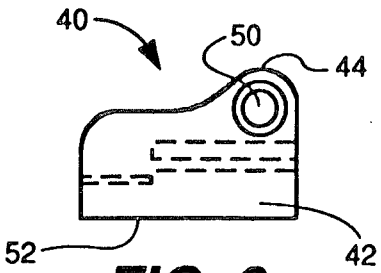
FIG. 3 is a side view of the jaw insert of FIG. 2.
Figure 2:
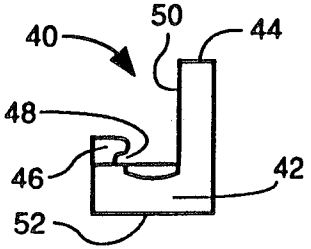
FIG. 2 is a front view of a jaw insert for use with the locking pliers of FIG. 1.

FIGS. 2-4 show a jaw insert 40. The jaw insert 40 includes a body portion 42 having an upstanding leg 44 projecting upwardly from one lateral edge thereof. Along the opposite lateral edge of the body portion 42, and L-shaped clip 46 extends upwardly and then inwardly toward the upstanding leg 44 so as to form an inwardly facing channel 48. The upstanding leg 44 has a bore 50 formed therethrough. A countersink 51 is formed concentric with the bore 50. The lower surface of the body portion 42 comprises a bearing surface 52.

Figure 7:
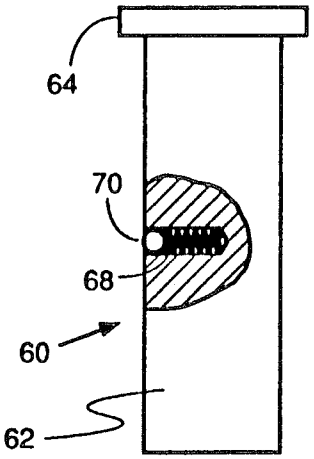
FIG. 7 is a partially cut away side view of the locking pin of FIG. 5 showing the locking pin assembled.
Figure 5:
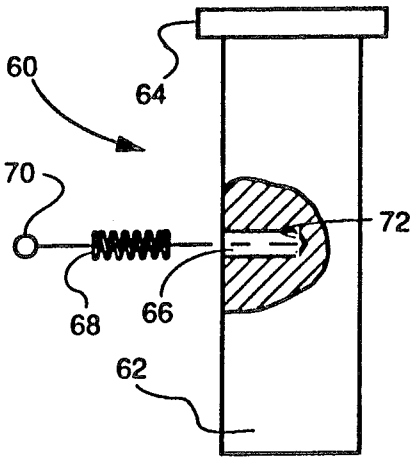
FIG. 5 is an exploded view of a locking pin assembly for securing the jaw insert to the locking pliers with the locking pin partially cut away to reveal interior detail.
Figure 6:
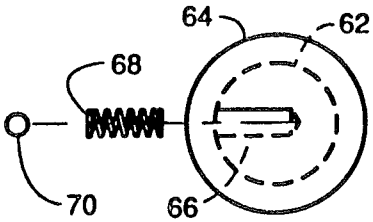
FIG. 6 is a top view of the locking pin of FIG. 5.

FIGS. 5-7 illustrate a locking pin 60 for removably securing the jaw inserts 40 to the locking pliers 10. The locking pin 60 comprises a shaft 62 having an enlarged head 64 at one end thereof. A radially extending bore 66 is located at an intermediate location along the shaft 62. A spring 68 is inserted into the radial bore 66, and a ball 70 is then inserted into the bore atop the spring. The exterior surface of the shaft 62 around the radal bore 66 is then deformed by a process commonly known as "staking" to retain the ball 70 within the bore. The inner end of the spring 68 bears against the back wall 72 of the radial bore 66, and the outer end of the spring bears against the ball 70, biasing it outwardly. The spring 68 biases the ball 70 outwardly such that a portion of the circumference of the ball will protrude outwardly beyond the shaft 62 of the locking pin 60. However, the ball 70 is constrained from becoming dislodged from the bore 66 by the inwardly deformed edges of the bore.

Figure 8:
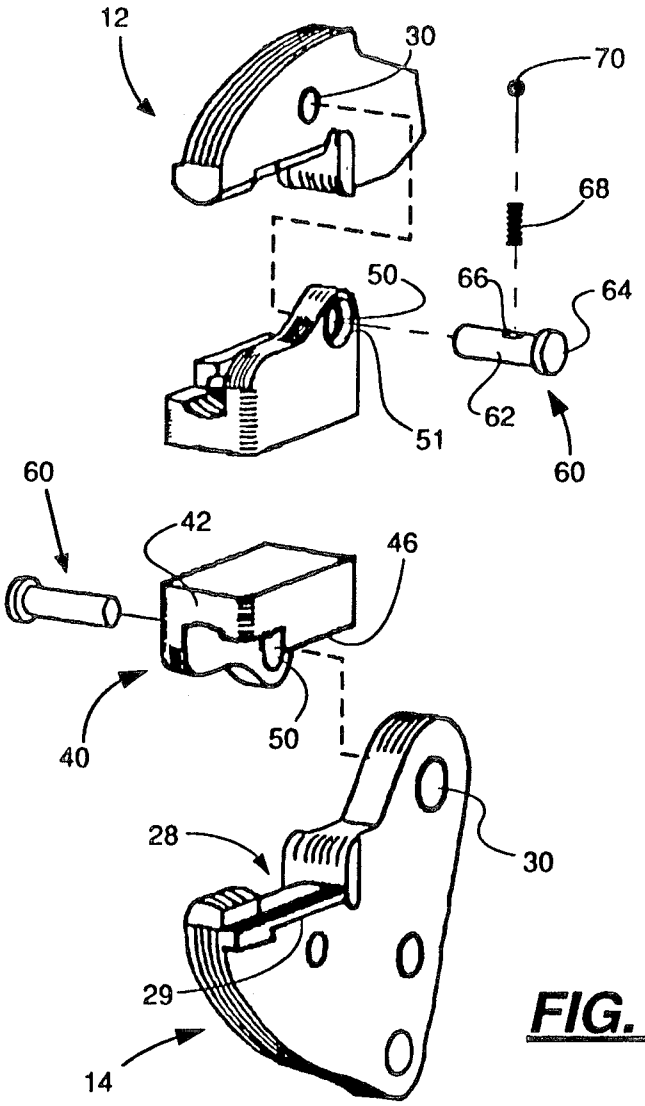
FIG. 8 is an exploded view illustrating the mounting of the jaw insert of FIG. 2 onto the locking pliers of FIG. 1.

Referring now to FIG. 8, the mounting of a pair of jaw inserts 40 to the upper and lower jaws 12, 14 of the pliers 10 is illustrated. Referring first to the installation of a jaw insert 40 onto the lower jaw 14, the L-shaped clip 46 is first hooked onto the laterally extending flange 29 so that the flange is received within the inwardly facing channel 48 of the jaw insert. The jaw insert is then pivoted onto the jaw 14 such that the body portion 42 is received within the recess 28 in the lower jaw. With the jaw insert 40 thus positioned, the bore 50 in the upstanding leg 44 of the jaw insert is correspondingly aligned with the bore 30 in the lower jaw 14.

The shaft 62 of a locking pin 60 is then inserted through the bore 50 in the upstanding leg 44 of the jaw insert 40 and into the bore 30 in the lower jaw 14. When thus installed, the head 64 of the locking pin 60 is recessed into the countersink 51 of the bore 50 in the upstanding leg 44 of the jaw insert 40. When the shaft 62 of the pin 60 is inserted into the bore 26 or 30 in a corresponding jaw 12 or 14, the ball 70 is spring-biased radially outwardly and into an interference fit with the walls of the bore. Under sufficient force, the ball 70 can be displaced radially inwardly to permit the pin 60 to be withdrawn, thereby to remove the jaw insert 40.

A second jaw insert 40 is mounted to the upper jaw 12 in the same manner as hereinabove described with respect to the lower jaw 14. The L-shaped clip 46 of the jaw insert 40 is hooked onto the flange 25 adjacent the recess 24, and the jaw insert is pivoted into position with the body portion 42 of the jaw insert disposed within the recess 24. A locking pin 60 is then inserted through the bore 50 in the jaw insert 40 and into the correspondingly aligned bore 26 in the upper jaw 12 to secure the jaw insert to the upper jaw.

Figure 9:
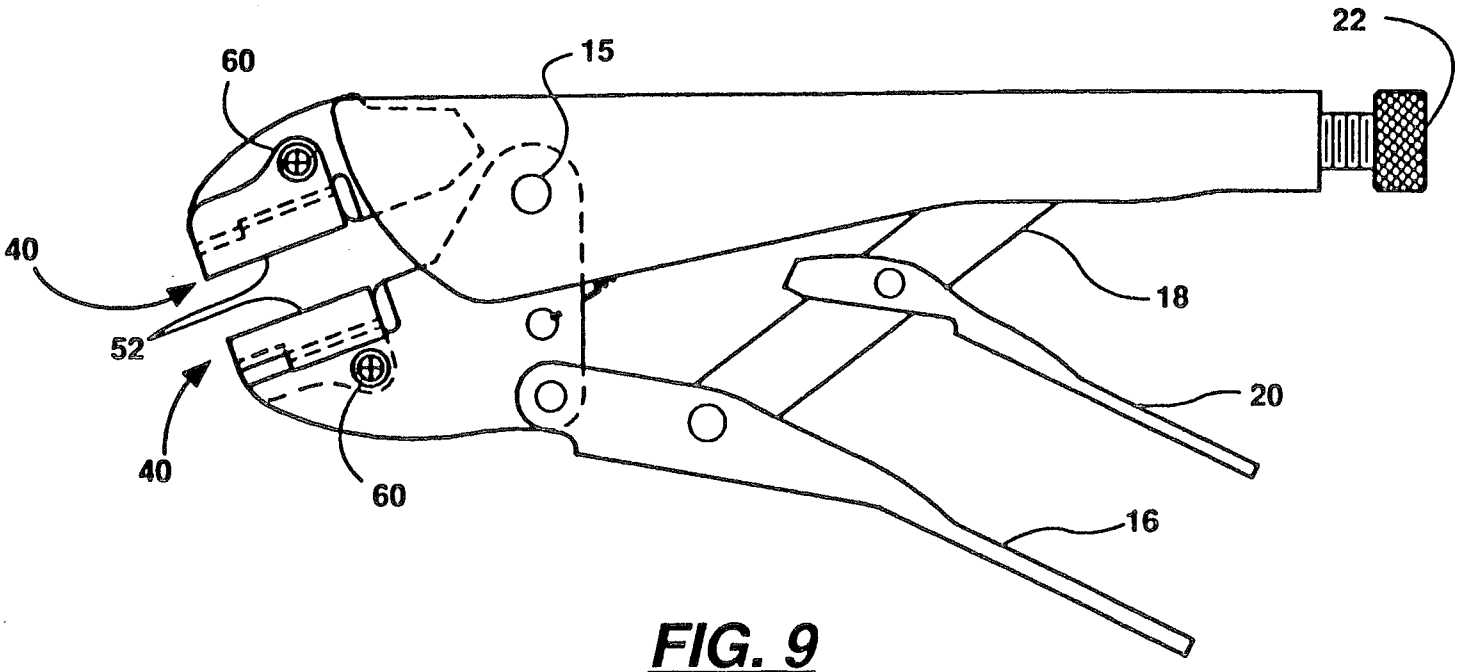
FIG. 9 is a side view of the locking pliers of FIG. 1 with the jaw inserts of FIG. 2 mounted thereto.

FIG. 9 shows the locking pliers 10 with jaw inserts 40 mounted thereto. As can be seen, the mutually facing bearing surfaces 52 of the respective jaw inserts 40 comprises the gripping or clamping surfaces of the pliers 10.

The locking pliers 10 of the present invention are used in the conventional manner. When the jaw inserts 40 become worn or damaged, or when a special use arises which requires different bearing surfaces 52, the locking pins 60 are extracted, and the old jaw inserts 40 are removed. New jaw inserts 40 are then mounted to the pliers, the L-shaped clips 46 of the jaw inserts 40 being hooked onto the flanges 25, 29 adjacent the recesses 24, 28 and the jaw inserts then pivoted into position with the body portion 42 of each jaw insert disposed within the corresponding recess 24, 28. A locking pin 60 is then inserted through the bore 50 in each jaw insert 40 and into the corresponding bore 26, 30 in the jaw 12, 14 to secure the jaw insert to the corresponding jaw.

An advantage of replaceable jaw inserts 40 is that when the bearing surfaces 52 become worn, broken, or scarred, the jaw inserts can be replaced much more easily than replacing a jaw and must less expensively than replacing the entire locking pliers. Another advantage is that jaw inserts 40 may be provided which have a variety of different bearing surfaces 52, for example, smooth, toothed, or with cutters, and the jaw inserts easily changed to suit the application at hand.

It will be appreciated that when a load is exerted against the jaw insert 40, the walls of the recesses 24, 28 within which the jaw inserts are positioned, and not the pins 60, bear the load. Rather than being a structural or load bearing member, the pins 60 serve only to maintain the jaw inserts 40 within their corresponding recesses 24, 28.

While the present invention has been disclosed with respect to locking pliers, it will be appreciated that the disclosed jaw inserts and mounting arrangement are easily adapted to the other types of pliers, including slip-joint pliers, channel-lock pliers, and the like. Also, while the present invention has been disclosed with respect to locking pins 60 which are retained by a spring loaded ball arrangement, it will be understood that any suitable retainer means for holding the locking pin in place can be employed, including a cotton pin, a lock washer, or the like.

Finally, it will be understood that the preferred embodiment has been disclosed by way of example, and that other modifications may occur to those skilled in the art without departing from the scope and spirit of the appended claims.

What is claimed is:

1. A tool comprising:

pliers having mutually opposing, articulating jaws;

means defining a recess in at least one of said jaws;

a flange formed on said at least one of said jaws adjacent said recess;

a jaw insert having a mating portion dimensioned to be received within said recess in said at least one of said jaws, a bearing portion formed transversely to said mating portion, a hook portion projecting from one lateral edge of said bearing portion, and a leg extending perpendicularly from the opposite lateral edge of said bearing portion;

said mating portion of said jaw insert being received within said recess in said at least one of said jaws;

means defining corresponding bores in said leg of said jaw insert and said at least on of said jaws;

said hook portion of said jaw insert engaging said flange formed on said at least one of said jaws to secure said hook portion of said jaw insert to said at least one of said jaws; and a pin inserted through said corresponding bores in said leg of said jaw insert and said at least one of said jaws for securing said leg of said jaw insert to said at least one of said jaws, whereby said jaw insert is removably attached to said pliers.

2. The tool oc claim 1, wherein said at least one of said jaws comprises both of said jaws, and wherein said jaw insert comprises a pair of jaw inserts, one jaw insert being removably attached to each of said pair of jaws.

3. The tool of claim 1, wherein said pin for securing said leg of said jaw insert to said at least one of said jaws comprises:

a shaft;

a radial bore formed in said shaft, said radial bore having a first portion extending through the exterior wall and having a first width and a second portion interior of said first portion and having a second width which is greater than said first width;

a ball disposed within said radial bore, said ball being dimensioned to move freely within said second portion but not to pass through said first portion such that a portion of the circumference of said ball extends outwardly of said shaft but said ball is retained within said bore; and a spring biasing said ball radially outwardly;

whereby said pin is retained in said at least one of said jaw by said ball beaing bised outwardly into an interference fit with said at least one of said jaws.

* * * * *